United States Patent [19]

Hara

[11] Patent Number: 4,609,136

[45] Date of Patent: Sep. 2, 1986

[54] RIVET DRIVER

[75] Inventor: Kunio Hara, Kawasaki, Japan

[73] Assignee: Nifco Inc., Yokohama, Japan

[21] Appl. No.: 765,648

[22] Filed: Aug. 15, 1985

[51] Int. Cl.[4] ..... B25C 1/04

[52] U.S. Cl. ..... 227/136; 227/120; 29/816

[58] Field of Search ..... 29/816, 509; 227/136, 227/120, 149, 156; 72/391

[56] References Cited

U.S. PATENT DOCUMENTS 3,930,297 1/1976 Potucek et al. ..... 227/136 X
4,131,009 12/1978 Hara et al. .
4,178,669 12/1979 Hara et al. ..... 29/509 X

FOREIGN PATENT DOCUMENTS 1814628 6/1970 Fed. Rep. of Germany ..... 227/136
5897441 4/1981 Japan .

*Primary Examiner*—James F. Coan
*Attorney, Agent, or Firm*—Trexler, Bushnell & Wolters, Ltd.

[57] ABSTRACT

A rivet driver is disclosed, which comprises a guide space through which a rivet belt is fed, feeder means for feeding the rivet belt through the guide space stepwise at increments equal to the pitch of the branch portions, re-directing means operable in an interlocked relation with the feeding operation of the rivet feeder means for bending the branch portion associated with the rivet located at a driving position in the guide space so that the rivet assumes a different orientation from that of the other rivets in the rivet belt, squeezing means for pushing the flange of the re-directed rivet to thereby squeeze out the rivet member from the branch portion, and a restoring mechanism for bending back and restoring the initial orientation of the branch portion bent by the re-directing means and leading the restored branch portion back to the guide space.

1 Claim, 28 Drawing Figures

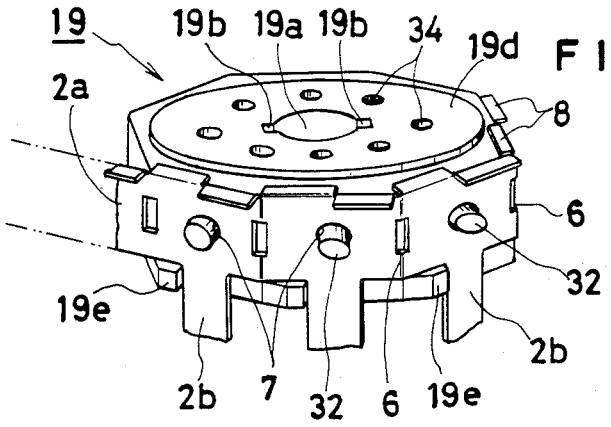
FIG. 13
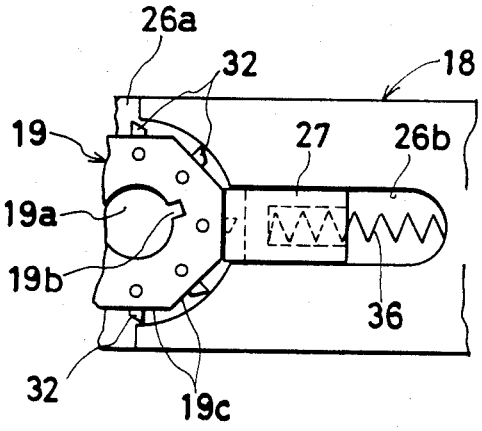
FIG. 14
FIG. 15(a)
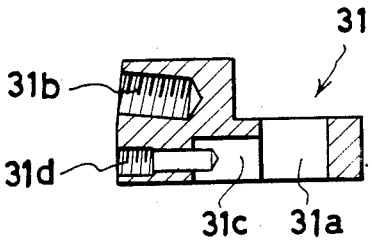
FIG. 15(b)
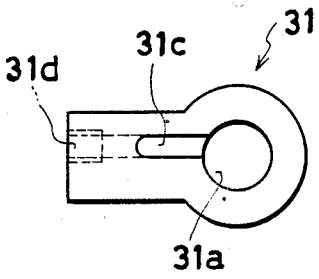

RIVET DRIVER

BACKGROUND OF THE INVENTION

Field of the Invention and Related Art

This invention relates to a rivet driver used with a belt of rivets consisting of a plurality of rivets integrally linked with one another via a connector strip, for driving rivets one by one to join overlapped panels or the like while permitting the connector strip to be recovered in an integral state after the required number of rivets have been driven.

As related art, U.S. Pat. No. 4,131,009 discloses a rivet driver used with a belt of rivets consisting of a plurality of pull-lock type rivets or blind fasteners. With this rivet driver, each rivet is separated from the belt of rivets together with the associated part of the connector strip when it is to be driven. The separated rivet is loaded in a piston type rivet driving mechanism to be driven. When the rivet is driven, it is separated from the associated segment of the connector strip and these segments are discharged one by one. This rivet driver has a complicated construction because each rivet is separated from the rivet belt when it is driven. In addition, the connector strip segments are scattered about, requiring troublesome work for their collection and disposal.

OBJECT AND SUMMARY OF THE INVENTION

An object of the invention is to provide a rivet driver which can carry out the rivet driving operation without scattering connector strip segments.

Another object of the invention is to provide a rivet driver which can carry out the rivet driving operation reliably even when using a rivet belt with a reduced size connector strip.

To attain the above objects of the invention, there is provided a rivet driver, which comprises a guide space through which a continuous rivet belt is fed, rivet feeder means for feeding the rivet belt through the guide space stepwise at increments equal to the pitch of the branch portions, re-directing means operable in an interlocked relation with the feeding operation of the rivet feeder mechanism for bending the branch portion associated with the rivet located at a driving position in the guide space so that the rivet assumes a different orientation from that of the other rivets in the rivet belt, squeezing means for pushing the flange of the re-directed rivet to thereby squeeze out the rivet member from the branch portion, and a restoring mechanism for bending back and restoring the initial orientation of the branch portion bent by the re-directing means and leading the restored branch portion back to the guide space.

With the rivet driver according to the invention, immediately before driving, the rivet to be driven is re-directed to assume an orientation different from the orientation of the other rivets in the rivet belt. As a result, no problem arises when the rivet driver is used with a rivet belt in which the individual rivets are integral with a continuous support. Besides, after each rivet has been driven, the stub of the associated branch portion remains integral with the support, so that, differently from what has been the case in prior art, there is no scattering of the stubs during rivet driving.

The above and other objects and features of the invention will become more apparent from the description of the preferred embodiments when the same is read with reference to the accompanying drawings.

BRIEF DESCRIPTION OF THE DRAWINGS

FIG. 6(*b*) is a front view showing the same rivet driver;

FIG. 6(*c*) is a top view, partly in section, showing the same rivet driver;

FIG. 9(*b*) is a side view showing the second guide member;

FIG. 12(*b*) is a side view showing the rotor;

FIG. 13 is a perspective view illustrating the manner in which a metal strip of the rivet belt engages with the rotor;

FIG. 14 is a view illustrating the manner in which the rotor and a stopper engage with each other;

FIG. 15(*a*) is a sectional view showing a ratchet holder in the rive driver shown in FIGS. 6(*a*) to 6(*c*);

FIG. 15(*b*) is a bottom view showing the ratchet holder;

Figure 19A:
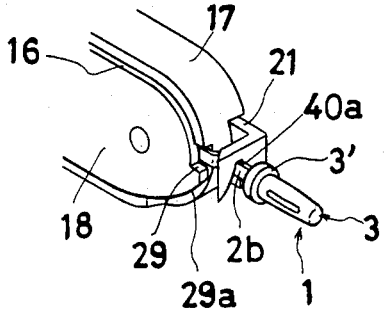
FIG. 19(*a*) is a perspective view illustrating the manner in which a rivet is engaged with the push bar.
Figure 20:
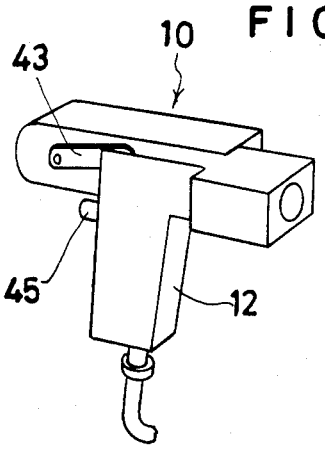
Figure 21:
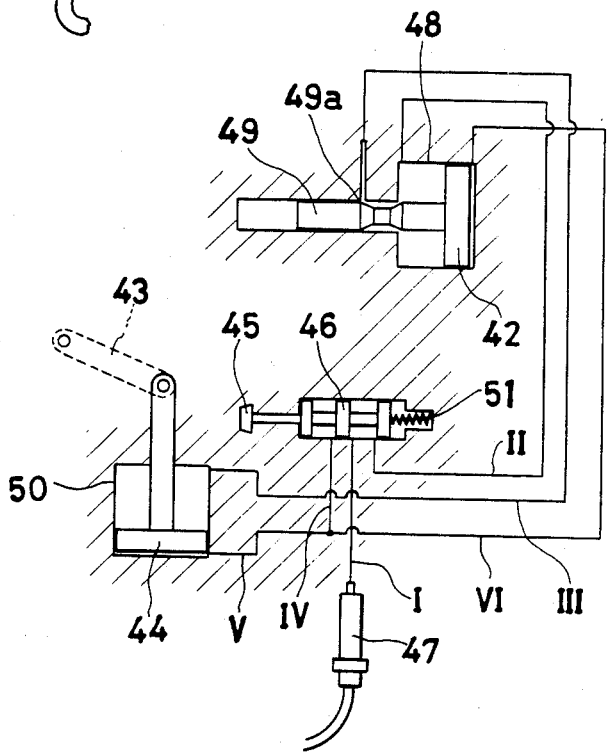

19(*b*) is a perspective view illustrating the manner in which side portions of the rivet are spread and the rivet is squeezed out with advance of the push bar;

FIG. 19(*c*) is a perspective view for explaining the manner in which the stub of a branch portion is bent back with the retraction of the push bar;

FIG. 20 is a perspective view showing another embodiment of the rivet driver according to the invention; and FIG. 21 is a schematic representation of a fluid pressure circuit in the rivet driver shown in FIG. 20.

DESCRIPTION OF THE PREFERRED EMBODIMENTS

Figure 1:
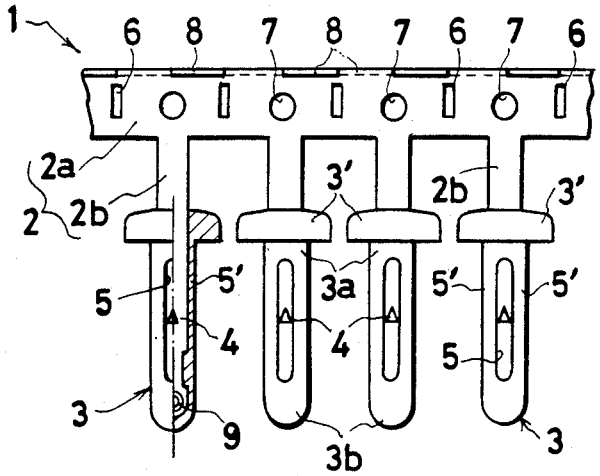
FIG. 1 is a front view, partly in section, showing a rivet belt to be used with a rivet driver according to the invention.
Figure 2:
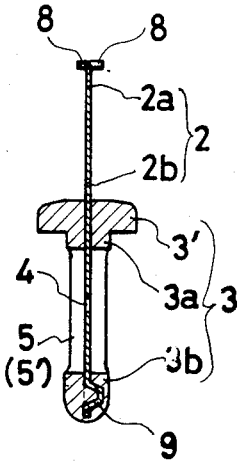
FIG. 2 is a sectional view showing the rivet belt shown in FIG. 1.

FIGS. 1 and 2 show a belt of rivets used with the rivet driver according to the invention. This rivet belt is disclosed in detail in Japanese Patent Public Disclosure No. SHO 58-97441.

The rivet belt 1 comprises a comb-shaped metal strip 2 having a main portion 2*a* and a plurality of branch portions 2*b* integrally extending from the main portion 2*a* at predetermined intervals, and rivets 3 injection molded one at the end of each branch portion 2*b*.

The branch portions 2*b* of the metal strip 2 extend at predetermined intervals from the main portion 2*a* much in the way that the stem extends from the bar of the letter T. Each branch portion 2*b* has an intermediate low mechanical strength portion 4. A rivet 3 is formed on each branch portion 2*b* as spaced apart from the main portion 2*a*. The low mechanical strength portion 4 is located within the rivet 3. The rivet 3 has a flange 3' provided at the end nearer the main portion 2*a*. In this example, the rivet 3 has a longitudinal slot 5 formed at an intermediate portion thereof so as to expose the low mechanical strength portion 4, and comprises upper and lower cylindrical portions 3*a* and 3*b* united by side portions 5' on the opposite sides of the slot 5. In this example, the low mechanical strength portion 4 is formed by providing a triangular hole in the branch portion 2*b*, i.e., the portions on the opposite sides of the triangular hole constitute the low mechanical strength portions. This structure is, however, by no means limitative.

The main portion 2*a* of the metal strip 2 has circular holes 7 formed at positions corresponding to the respective branch portions 2*b* and also has low mechanical strength portions 6 formed midway between adjacent holes 7. The low mechanical strength portions 6 facilitate the bending of the continuous metal strip 2 at their positions. The edge of the main portion 2*a* opposite the branch portions 2*b* is provided with bent portions 8 alternately projecting from the opposite sides.

Figure 3:
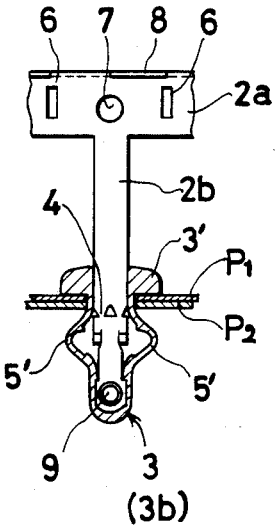
FIGS. 3 to 5 are views for explaining the manner in which two panels are joined together using a rivet.
Figure 4:
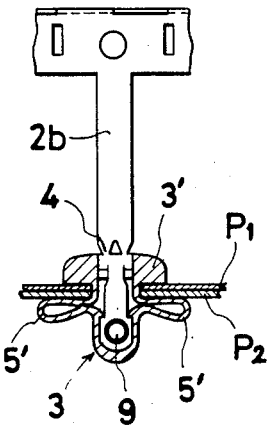
Figure 5:
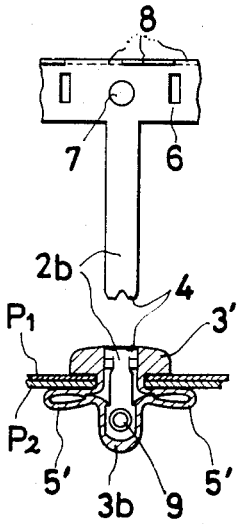
Figure 6C:
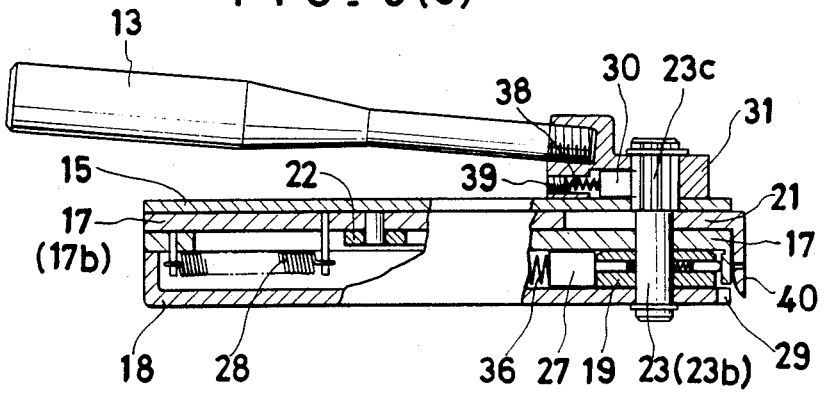
FIG. 6(*a*) is a side view showing an embodiment of the rivet driver according to the invention.
Figure 6A:
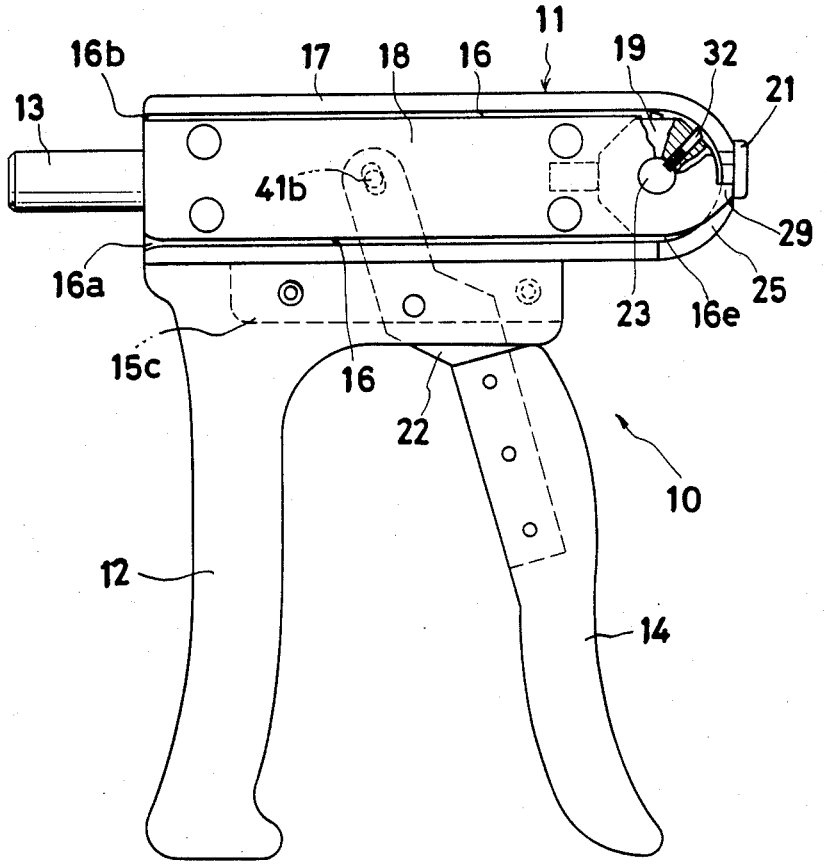
Figure 6B:
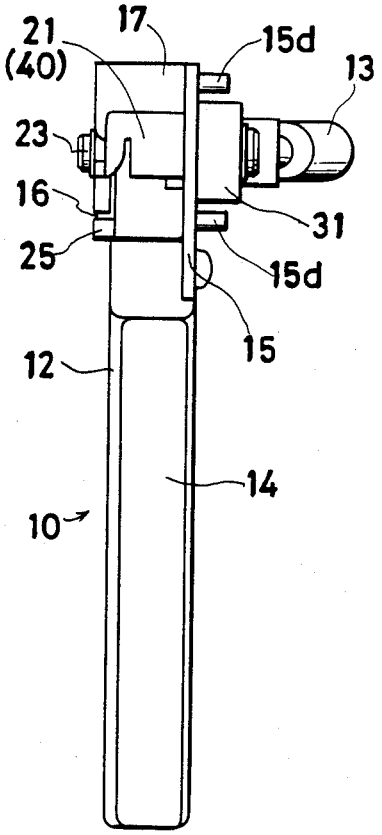

FIGS. 3 to 4 illustrate the manner in which two overlapped panels $P_1$ and $P_2$ are secured together using a rivet 3. First, the rivet 3 is inserted through aligned holes formed in the two panels until the lower surface of the flange 3' abuts against the top of the upper panel $P_1$, and in this state the rivet 3 and the associated branch portion 2*b* relatively squeezed to push or pull the branch portion 2*b* out the rivet member 3. At this time, the side portions 5' of the rivet 3 are outwardly bent into a V-shape (FIG. 3) until they are eventually foldedly buckled under the lower panel $P_2$. Thus, the overlapped panels are clamped between the lower surface of the flange 3' and buckled side portions 5' (FIG. 4). The branch portion 2*b* is ultimately separated from the rivet 3 at the low mechanical strength portion 4. The position of the low mechanical strength portion 4 is such that the separation occurs at a position not higher than the flange 3' of the rivet 3, i.e. occurs within the rivet 3. The part of the branch portion 2*b* below the low mechanical strength portion 4 is formed with a recess 9 and the plastic material of the rivet 3 on the branch portion 2*b* fills the recess 9, assuring that the part of the branch portion 2*b* beneath the low mechanical strength portion 2*b* will reliably remain in the rivet 3.

In the aforementioned rivet belt 1, the metal strip 2 includes the main portion 2*a* and integral branch portions 2*b*, on which the rivets 3 are formed by injection molding. This is desirable from the standpoint of avoiding the waste of material of the metal strip 2. In this case, however, when a rivet 3 is to be inserted through the aligned holes of panels $P_1$ and $P_2$, the insertion is obstructed by the adjacent rivet. It is thus necessary to separate the main portion at a position midway between adjacent branch portions. Besides, there is a disadvantage in that stubs of the branch portions of the metal strip (i.e. the segments of the branch portions above the respective low mechanical strength portions) are scattered about by the driving of the rivets.

According to the invention, when the rivet driver is loaded with the rivet belt, the rivets can be inserted one by one into panel holes or the like to join the panels together. In addition, parts of the branch portions of the metal strip above the low mechanical strength portions are not scattered but can be recovered in an integral state together with the main portion of the metal strip.

An embodiment of the rivet driver according to the invention will now be described with reference to FIGS. 6 to 19. The illustrated rivet driver 10 comprises a body 11, a grip 12 supporting the body 11 and two levers 13 and 14. The body 11 includes a rivet feeder mechanism, a re-directing mechanism, a squeezing mechanism, and a restoring mechanism. The rivet feeder mechanism includes a base plate 15, a first guide member 17 which is secured to the base plate 15 and constitutes an outer wall of a guide space 16 through which the main portion 2*a* of the rivet belt is guided, a second guide member 18 which is fitted in the first guide member 17 and constitutes an inner wall of the guide space 16, a rotor 19, and a ratchet mechanism 20 for feeding the rivet belt through the guide space 16 stepwise with a step interval corresponding to the pitch of the branch portions 2*b*. The re-directing mechanism operates in interlocked relation with the feeding operation of the rivet feeder mechanism to bend the branch portion 2*b* associated with a rivet 3 located at the driving position in the guide space 16 so that the rivet 3 assumes a different orientation form that of the other rivets in the belt and outwardly projects from the body 11. The squeezing mechanism has a push bar 21 and an inside lever 22, and it receives the re-directed rivet 3 and pushes the flange 3' thereof to squeeze the rivet 3 from the branch portion 2*b*. The restoring mechanism bends back and restores the initial orientation of the branch portion 2*b* bent by the re-directing mechanism and leads the restored branch portion 2*b* back to the guide space 16. The base plate 15 has a plurality of bolt holes 15*a* for mounting component parts. It also has a hole 15*b* formed in one end portion, which hole 15*b* is loosely penetrated by a shaft 23 of the rotor 19. It further has a lower mounting portion 15*c* which is mounted in the grip 12.

Figure 8:
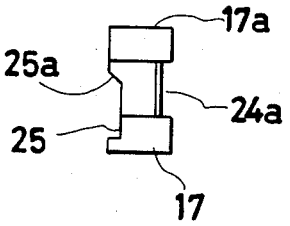
FIG. 8 is a side view showing a first guide member in the rivet driver shown in FIGS. 6(*a*) to 6(*c*)

The first guide member 17 has a U-shaped wall 17*a* open at one end and a partition wall 17*b* defining left and right spaces with the U-shaped wall 17*a*. The space defined by one side surface of the partition wall 17*b* and the corresponding portion of the U-shaped wall 17*a* constitutes a first accommodation space 24*a* open on one side. The push bar 21 is slidably accommodated in the first accommodation space 24*a*. The space defined by the other side surface of the partition wall 17*b* and the corresponding portion of the U-shaped wall 17*a* constitutes a second accommodation space 24*b* open on the other side. The second guide member 18 is fitted in the second accommodation space 24*b*. The portion of the U-shaped wall 17*a* cooperating to define the second accommodation space 24*b* is formed at a substantially central arcuate portion thereof with a notch 25 in which the branch portion 2*b* of the metal strip 2 of the rivet belt is received. The notch 25 has an inclined end surface 25*a* (FIG. 8).

Figure 9A:
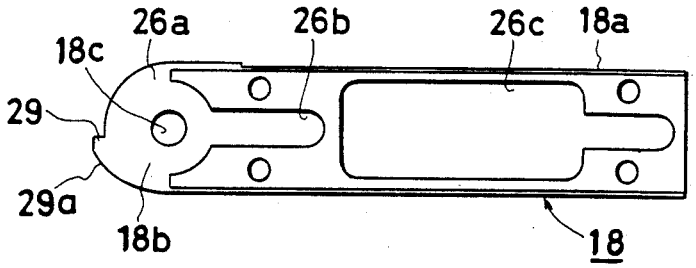
FIG. 9(*a*) is a plan view showing a second guide member in the rivet driver shown in FIGS. 6(*a*) to 6(*c*)
Figure 9B:
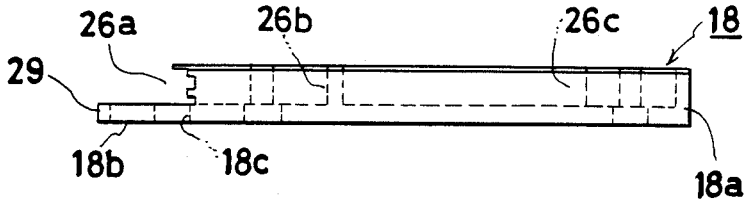

The second guide member 18 is a thick member having an edge surface adapted to be located along and slightly inwardly of the inner surface of the U-shaped wall 17*a* of the first guide member 17 (FIG. 9). The second guide member 18 is fitted in and occupies a portion of the second accommodation space 24*b* of the first guide member 17. The second guide member 18 is fitted in the second accommodation space 24*b* of the first guide member 17 in such manner that the substantially U-shaped guide space 16 open at both ends 16*a* and 16*b* is defined between the inner surface of the U-shaped wall 17*a* of the first guide member 17 and the edge surface 18*a* of the second guide member 18.

Figure 10:
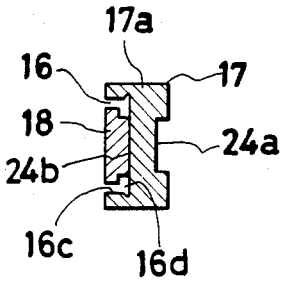
FIG. 10 is a sectional view showing a guide space in the rivet driver shown in FIGS. 6(*a*) to 6(*c*)

Actually, the guide space 16 has a substantially T-shaped sectional profile consisting of a longitudinal portion 16*c* extending from the open end and a transverse portion 16*d* extending from the other end of the longitudinal portion 16*a* (FIG. 10). The width of the longitudinal portion 16*c* of the space 16 is slightly greater than the thickness of the metal strip 2 of the rivet belt 1. The depth of the longitudinal portion 16*c* is such that the exposed portion of the main portion 2*a* of the metal strip 2 is received while the rivet 3 projects from the guide space 16. The transverse portion 16*d* of the guide space 16 is adapted to receive the bent portions 8 of the metal strip 2 to position the rivet belt and prevent detachment thereof from the guide space 16. If the rivet belt does not have the bent portions 8, the transverse portion 16*d* is unnecessary. In case of a rivet belt having bent portions extending from only one side, the guide space may have a substantially L-shaped sectional profile.

Figure 11:
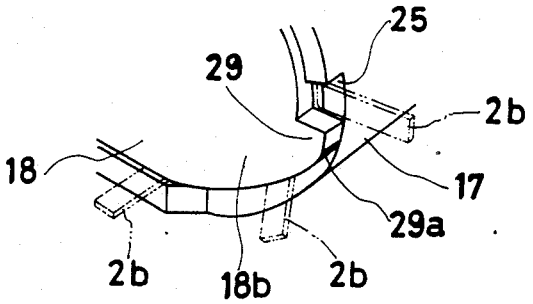
FIG. 11 is a fragmentary enlarged perspective view showing a tapered end surface of the second guide member shown in FIG. 9 in engagement with a rivet belt.
Figure 7:
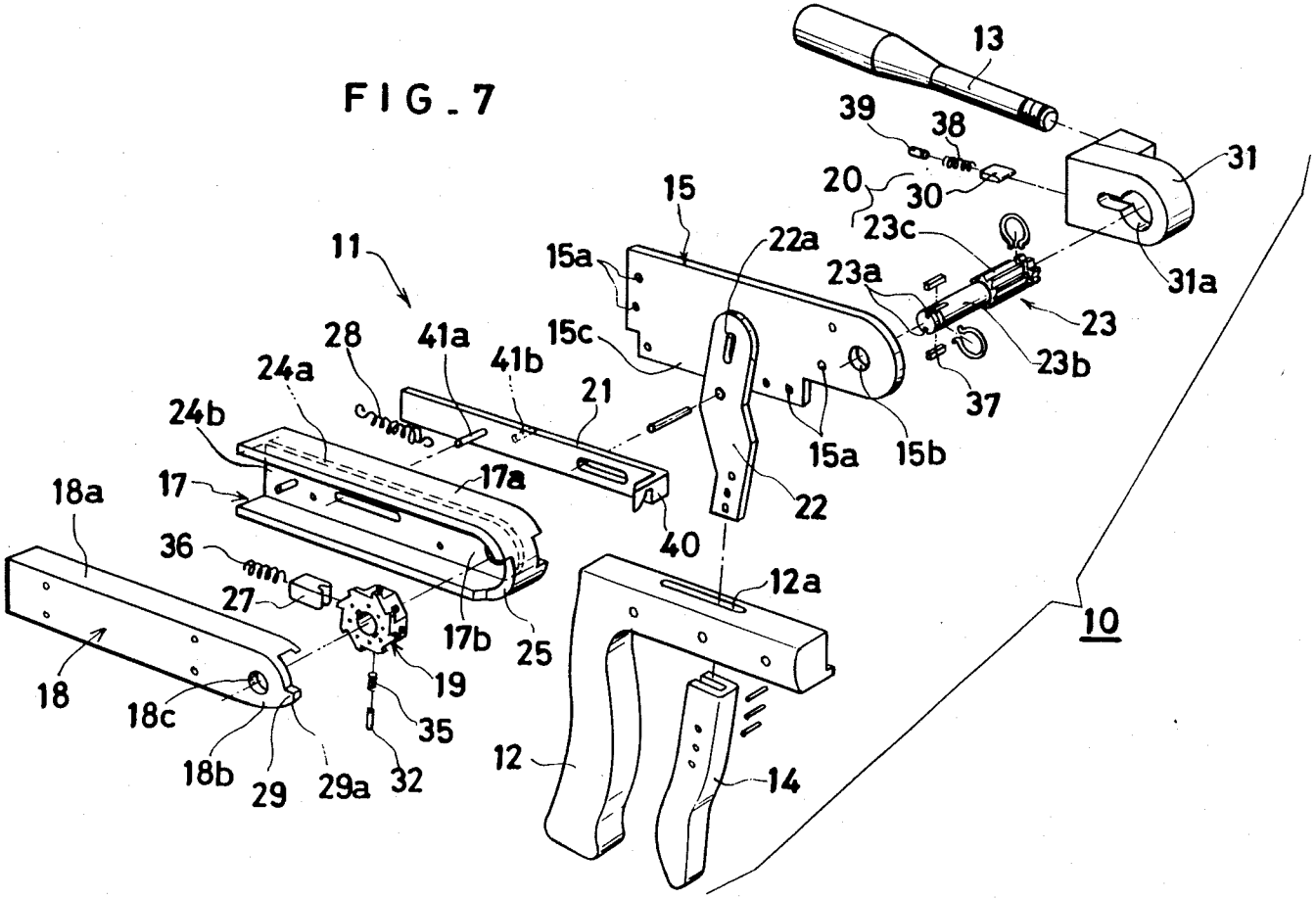
FIG. 7 is an exploded perspective view of the rivet driver shown in FIGS. 6(*a*) to 6(*c*)

The second guide member 18 has first to third accommodation spaces 26*a* to 26*c*. The first accommodation space 26*a* is open at the arcuate edge portion, and the rotor 19 is accommodated in this space 26*a*. The second accommodation space 26*b* communicates with and extends rearwardly from the first accommodation space 26*a*, and a stopper 27 which engages with the rotor 19 is accommodated in this space 26*b*. The third accommodation space 26*c* is formed in a substantially central portion of the second guide member 18 and accommodates a spring 28 which is attached to the push bar 21. A head portion 18*b* of the second guide member 18 has a central through-hole 18*c* which is penetrated by the shaft 23 of the rotor 19. The head portion 18*b* has a projection 29 projecting toward the guide space 16 substantially over one half of the arcuate edge. The projection 29 has a downwardly tapered edge surface 29*a*. The tapered edge surface 29*a* engages a part of the branch portion 2*b* of the metal strip projecting from the guide space 16. While the rivet belt 1 proceeds along the arcuate portion 16*e* of the guide space 16 for about 45 degrees with respect to the axis of the shaft 23, the branch portion 2*b* is bent by about 90 degrees with respect to the guide space 16, the bent branch portion 2*b* outwardly projecting from the body 11 (FIG. 11).

The rivet feeder mechanism for feeding the rivet belt 1 includes the rotor 19 and the ratchet mechanism 20, which is constituted by the shaft 23 of the rotor 19 and a ratchet holder 31 accommodating a pawl 30.

Figure 12A:
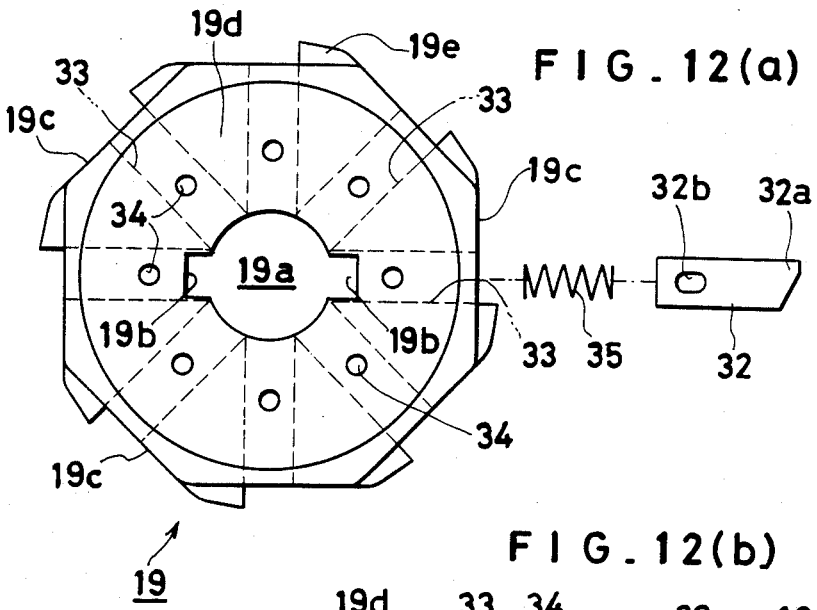
FIG. 12(*a*) is a plan view of a rotor and a feed pin in the rivet driver shown in FIGS. 6(*a*) to 6(*c*)
Figure 12B:
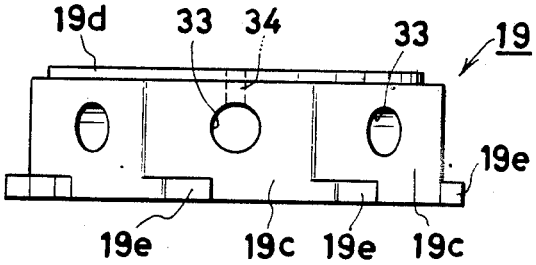

As shown in FIG. 12, the rotor 19 is substantially an octagonal cylindrical member having a central hole 19*a*, through which an end portion of the shaft 23 is inserted. A pair of key grooves 19*a* are formed in the circumferential wall surface of the hole 19*a* for preventing idling of the shaft 23. Each side 19*c* of the octagon of the rotor 19 has a width equal to the pitch of the branch portions 2*b*. The rotor 19 has radial holes 33 extending one from each side 19*c* of the octagonal peripheral surface toward the hole 19*a* and axial holes 34 each communicating with each radial hole 33. The rotor 19 further has radial projections 19*e* formed one each along one edge of the trailing end portion (as determined by the direction of rotation of the rotor 19) of each side 19*c* of the octagon. The radial projections 19*e* engage one edge of the stem portion of the respective branch portions of the rivet belt.

A cylindrical feed pin 32 is inserted together with a spring 35 in each radial hole 33 of the rotor 19. The feed pin 32 has a tapered outer end 32*a* and has a longitudinal slot 32*b* formed at the inner end portion thereof. The feed pin 32 is inserted in the radial hole 33 such that its pointed end is on the leading side with respect to the direction of rotation of the rotor, and a pin inserted into the associated axial hole 34 of the rotor is received in the slot 32*b*. The pin 32 is thus held biased in the projecting direction, i.e., held in the projected state. As the rivet belt is fed by the rotor 19, the main portion 2*a* of the metal strip 2 comes into engagement with the respective surfaces 19*c* of the rotor periphery, so that the tapered end 32*a* of the pin is readily received in one of the circular holes 7 in the main portion 2*a* (FIG. 13).

The stopper 27 is in engagement with one of the surfaces 19*c* of the rotor 19 at all times. The stopper 27 is accommodated in the second accommodation space 26*b* of the second guide member 18 and is biased by a spring 36 toward the surface 19*c* of the rotor 19 so as to determine the stop position of the rotor 19 when the rotor 19 is rotated (FIG. 14).

The shaft 23 consists of a shaft portion 23*b* having a pair of axial key grooves 23*a* extending from one end face and a gear portion having ratchet teeth 23*c* extending parallel to the axis from the shaft portion 23*b* to the other end of the shaft. The shaft portion 23*b* of the shaft 23 is inserted in the hole 19*a* of the rotor 19 and is keyed to the rotor 19 by keys 37 inserted in the key grooves 23*a* of the shaft 23 and the key grooves 19*b* of the rotor 19. The gear portion of the shaft 23 is fitted in the ratchet holder 31.

Figure 16:
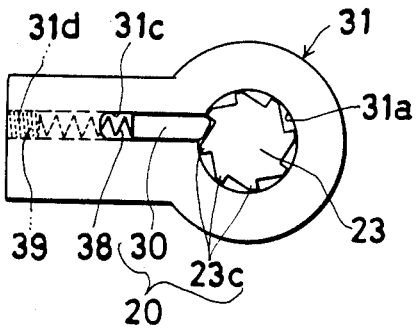
FIG. 16 is a view for explaining a ratchet mechanism in the rivet driver shown in FIGS. 6(*a*) to 6(*c*)

The ratchet holder 31 has a through-hole 31*a* formed in one half portion thereof, the gear portion of said shaft 23 being loosely inserted through the hole 31*a*. The other half portion of the ratchet holder 31 has a threaded bore 31*b* (FIG. 15(*a*)), into which an end portion of the feed lever 13 is screwed. A C-ring is fitted on the end portion of the shaft 23 projecting from the hole 31*a*. The ratchet holder 31 is rotated about the shaft 23 in unison with the feed lever 13 (FIGS. 15 and 16). The ratchet holder 31 has a slide groove 31*c* open at the bottom and communicating with the hole 31*a*. The pawl 30 is slidably accommodated in the slide groove 31*c*. The ratchet holder 31 has a retainer bore 31*d* formed from one end face and communicating with the slide groove 31*c*. A spring 38 is loosely fitted in the retainer bore 31*d*. The portion of the retainer bore 31*d* adjacent to the end face mentioned above is formed with a female thread. An adjusting screw 39 is screwed in the threaded bore portion such that its inner end engages with the spring 38.

The pawl 30, which is fitted in the slide groove 31*c* of the ratchet holder 31, has its front end engaged in the ratchet teeth 23*c* of the shaft 23 and the rear end extending in the retainer bore 31*d*, and it is biased toward the front end by the spring 38 retained in the retainer bore 31*d*. The spring 38 fitted in the retainer bore 31*d* has one end in engagement with the rear end of the pawl 30 and the other end in engagement with the adjusting screw 39 screwed in the retainer bore 31*d*. The biasing force acting on the pawl 30 can be adjusted by adjusting the extent of intrusion of the adjusting screw 39.

The ratchet mechanism 20 thus transmits the torque of the feed lever 13 to the rotor 19 in one direction only, and it is in an idle state when the lever is turned in the opposite direction.

Figure 17:
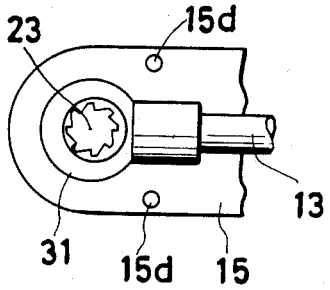
FIG. 17 is a fragmentary side view showing part of a body of the rivet driver shown in FIGS. 6(*a*) to 6(*c*)

The rotational angle of the ratchet holder 31 is restricted by a pair of stoppers 15*d* projecting from the base plate 15. In this embodiment, the ratchet holder 31 can be rotated by approximately 45 degrees about the shaft 23 (FIG. 17).

Figure 18:
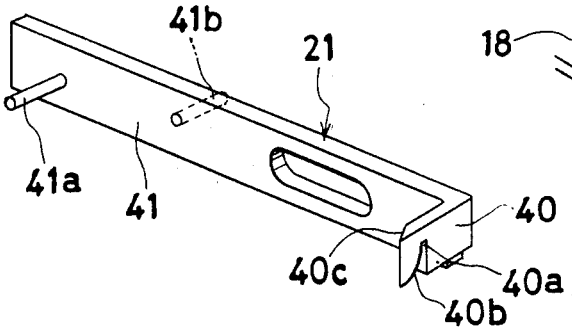
FIG. 18 is an enlarged perspective view showing a push bar in the rivet driver shown in FIGS. 6(*a*) to 6(*c*)

The squeezing mechanism for squeezing the rivet 3 includes the push bar 21 and the inside lever 22 coupling the push lever 14 and the push bar 21. The push bar 21 is a substantially L-shaped member (FIG. 18). Its main portion 41 is slidably accommodated in the first accommodation space 24*a* of the first guide member 17 with its bent end portion 40 projecting from the body 11. The bent end 40 of the push bar 21 has a notch 40*a* in its lower side for receiving a branch portion 2*b* of the metal strip 2. The notch 40*a* has an arcuate edge surface, which serves as a guide surface 40*b*, along which the branch portion 2*b* is guided. The bent end portion 40 has an inwardly inclined end face 40*c*. The main portion 41 of the push bar 21 has first and second pins 41*a* and 41*b* projecting from its opposite sides, the spring 28 being attached to the first pin 41*a* and the inside lever 22 being adapted to engage with the second pin 41*b*. The first pin 41*a* projects through a slot formed in the partition wall 17*b* of the first guide member. One end of the spring 28 is attached to the portion of the first pin 41*a* projecting from the partition wall 17*b*, and the other end thereof is attached to a pin projecting from the partition wall 17*b*. The push bar 21 is thus biased by the spring 28 toward its rear end, i.e., in the direction of retraction.

The inside lever 22 has a central portion pivoted on the base plate 15 and has a longitudinal slot 22*a* formed in one end portion. The second pin 41*b* of the push bar 21 is received in the slot 22*a*. The other end portion passes through a slit 12*a* formed in the grip 12 and is accommodated in the lever 14. The lever 14 is secured by pins to the portion of the inside lever 22 accommodated therein.

Thus, by gripping or applying finger pressure to the lever 14, the inside lever 22 is turned about the pivotal support pin. Consequently, the end of the slot 22*a* of the inside lever 22 is brought into engagement with the second pin 41*b*, and the push bar 21 is advanced against the biasing force of the spring 28. When the lever 14 is released, the push bar 21 is retracted by the biasing force of the spring 28. At this time, the second pin 41*b* of the push bar 21 is brought into engagement with the other end of the slot 22*a* of the inside lever 22 to return the lever 14 to its initial position.

The most advanced position of the push bar 21 is determined according to the structure of the particular type of rivet belt to be used. With the rivet belt 1 utilized in accordance with the invention, the most advanced position of the push bar 21 is set to be beyond a position corresponding to the required extent of squeezing of the rivet 3 for squeezing out the rivet 3 from the branch portion 2*b* to join together the overlapped panels. Therefore, after the rivet 3 has been completely squeezed to join the panels with the advance of the push bar 21, the push bar 21 is further advanced so that the branch portion 2*b* is broken off at the low mechanical strength portion 4. The portion of the branch portion 2*b* above the low mechanical strength portion 4 thus remains integral with the main portion 2*a*.

The rivet driver 10 having the above construction is assembled as follows. First, the inside lever 22 is pivotally mounted on one side of the base plate 15. The shaft 23 is inserted from the gear portion into the through-hole 31*a* of the ratchet holder 31, into which the pawl 30, spring 38 and adjusting screw 39 have been assembled, such that the end of the pawl 30 is engaged with the ratchet teeth 23*c*. The shaft 23 is then retained by fitting a C-ring on the end portion thereof projecting from the ratchet holder 31. Then, the leading end of the shaft portion 23*b* of the shaft 23 is inserted through the hole 15*b* of the base plate 15 from the other side thereof. Subsequently, the first guide member 17 with the push bar 21 therein is mounted on the aforementioned one side of the base plate 15, with the spring 28 stretched between the push bar 21 and first guide member 17. Then, the keys 37 are fitted in the key grooves 23*a* of the shaft 23, and the second guide member 18, into which the rotor 19, stopper 27 and spring 36 have been assembled, is mounted on the base plate 15 with the keys 37 received in the key grooves 19*b* communicating with the hole 19*a* of the rotor 19. A C-ring is then fitted on the end portion of the shaft 23 projecting from the second guide member 18 to retain the shaft 23. Finally, bolts are inserted through the bolt holes 5*a* from the outside of the base plate 15 to complete the assembly of the body 11.

Thereafter, the mounting portion 15*c* of the base plate 15 is inserted together with the free end portion of the inside lever 22 into the slit 12*a* of the grip 12, and the base plate 15 is secured to the grip 12 by pins inserted from the outside of the grip 12. Then, the threaded end portion of the feed lever 13 is screwed into the threaded bore 31*b* of the ratchet holder 31, thereby securing the feed lever 13. Further, the lower end portion of the inside lever 22 is inserted into a groove formed in the lever 14, and the inside lever 22 is secured to the lever 14 by pins inserted into the two from the outside of the lever 14.

In using the rivet driver 10 having the above construction, the rivet belt 1 is first loaded in the guide space 16 of the rivet driver 10.

To load the rivet belt 1 in the guide space 16, the rivet belt 1 is inserted into the guide space 16 from the inlet end thereof, i.e., the end 16*a*, with the bent portions 8 of the main portion 2*a* of the metal strip 2 fitted in the transverse portion 16*d* of the guide space 16, and is fed through the guide space 16 until the leading branch portion 2*b* is engaged with the feeder mechanism in the guide space 16. As the rivet belt 1 is fed, one of the feed pins 32 of the rotor 19 eventually engages in the leading hole 7 of the main portion 2*a*, whereupon the rivet belt 1 is in its readied position.

Then, the first rivet 3 is loaded in the push bar 21 by operating the feed lever 13 twice or so (FIG. 19(*a*)). When the feed lever 13 is turned upwards, the pawl 30 is brought into engagement with the ratchet teeth 23*c* to cause rotation of the rotor 19 in the counterclockwise direction by about 45 degrees via the shaft 23. As a result, the part of the main portion 2*a* of the metal strip 2 associated with the first rivet 3 is bent relative to the corresponding part of the second rivet at the low mechanical strength portion 6 between these two parts, so as to be fed out along the arcuate portion 16e of the guide space 16. At this time, the feed pin 32 of the rotor 19 is engaged in the leading hole 7 in the main portion 2a, while the associated radial projection 19e of the rotor 19 is engaged with the rear edge of the leading branch portion 2b. The feed pin 32 and radial projection 19e thus cooperate with each other to feed out the main portion 2a associated with the leading rivet 3, while the next feed pin 32 and radial projection 19e engage the hole 7 and branch portion 2b associated with the second rivet. During this rotation, the branch portion 2b for the leading rivet is brought into engagement with the tapered edge surface 29a of the head portion 18b of the second guide member 18 and bends the leading branch portion 2b slightly outwardly with respect to the guide space 16 (FIG. 11). Then, the feed lever 13 is turned upwardly. At this time, the ratchet mechanism 20 idles. When the feed lever 13 is subsequently turned downwardly, the rotor 19 is further turned about 45 degrees in the counterclockwise direction. With this rotation, the main portion for the leading rivet is fed out along the arcuate portion 16e. At this time, the leading branch portion 2b is bent by the tapered end surface 29a of the head portion 18b of the second guide member 18 by about 90 degrees with respect to the guide space 16. The branch portion 2b thus enters the notch 25 of the first guide member 17 and is stopped at the driving position. At this time, the leading branch portion 2b is received in the notch 40a of the push bar 21.

Figure 19B:
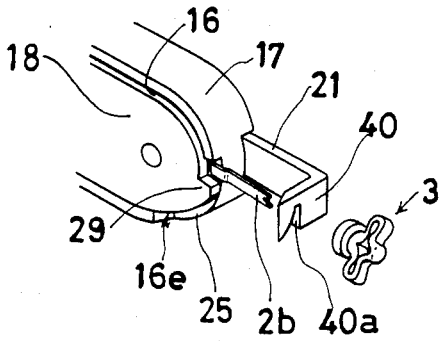
Figure 19C:
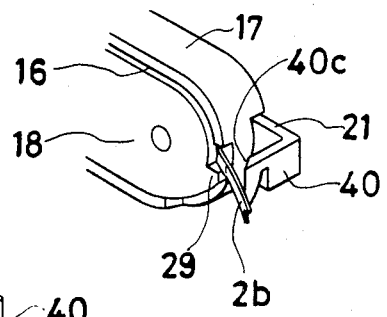

Subsequently, the leading rivet 3 is driven. This is done by passing the rivet 3 through the aligned holes of overlapped panels and then gripping the lever 14. With the operation of the lever 14, the push bar 21 is advanced by the inside lever 22 against the biasing force of the spring 28. The push bar 21 is advanced toward the rivet 3 with the branch portion 2b received in the notch 40a, and the outer surface of the bent end portion 40 of the push bar 21 is eventually brought into contact with the flange 3' of the rivet 3. With further advance of the push bar 21, the rivet 3 is squeezed forward in its axial direction by the outer surface of the bent end portion 40. Since the flange 3' of the rivet 3 is held against the panel, force acts on the rivet 3 so as to pull out the branch portion 2b. Consequently, the side portions 5' of the rivet 3 begin to be spread outwardly. Eventually, they are fully spread and foldedly buckled under the panels, whereby the overlapped panels are clampedly joined together between the lower surface of the flange 3' and the buckled side portions 5' of the rivet 3. Ultimately, the push bar 21 is stopped at the most advanced position. When the push bar 21 comes to the vicinity of its most advanced position, the branch portion 2b is separated at the low mechanical strength portion 4, and the portion above the low mechanical strength portion 4 remains integral with the main portion 2a (FIG. 19b). When the lever 14 is subsequently released, the push bar 21 retracts to its initial position under the biasing force of the spring 28. As the push bar 21 retracts, the remaining bent portion of the branch portion 2b engages the tapered end surface 40a of the push bar 21 to be slightly bent back in the opposite direction (FIG. 19c). Thereafter, the feed lever 13 is turned downwardly again to load the second rivet 3 in the push bar 21. At this time, the remaining bent portion of the leading branch portion 2b is bent as it slides along the inclined end surface 25a of the notch 25 of the first guide member 17. It is thus bent to be in the same plane as the main portion 2a and is forced into the guide space 16 again. As the sequence of operations described above is repeated, the main portion 2a, integrally with the stubs of successive branch portions 2b separated at the low mechanical strength portions 4, is progressively fed toward the outlet, i.e., the other end 16b, of the guide space 16. When the feed lever 13 is operated several times after driving of the last rivet 3, one of the feed pins 32 of the rotor 19 disengages from the last hole 7 in the main portion 2a, so that the main portion 2a becomes free in the guide space 16. Thus, stubs of the branch portions 2b separated at the low mechanical strength portions 4 and remaining integral with the main portion 2a can be recovered together with the main portion 2a by withdrawing the main portion 2a from the other end of the guide space 16.

In the above embodiment of the rivet driver the levers are manually operated. However, this is by no means limitative, and it is possible to make use of fluid pressure, e.g., pneumatic pressure, for operating the levers.

FIGS. 20 and 21 show another embodiment of the rivet driver according to the invention, in which levers are operated by fluid pressure.

In this embodiment, the body 10 has the same construction as the body in the preceding embodiment. This embodiment includes a driving piston 42 which moves the push bar 21, a feed piston 44 for rotating the rotor 19 via the ratchet mechanism 20, and an operating valve 46 which is operated by operating a push button 45. The valve operates the pistons by fluid pressure, i.e. pneumatic pressure in this embodiment.

As shown in the pneumatic circuit in FIG. 21, compressed air from an air compressor is led to a nipple 47 mounted inside a grip 12. From the nipple 47 it is supplied through a line I to the operating valve 46. From the valve 46, it is led through a line II to the left chamber of a cylinder 48 of the driving piston 42. From the left chamber, it is led through a duct 49a formed in a piston rod 49 of the driving piston 42 and a line III to enter the upper chamber of a cylinder 50 of the feed piston 44.

When the push button 45 is depressed against the force of a spring 51 in this state, the operating valve 46 is switched. As a result, the line I is communicated with a line IV via the chamber. The line IV branches into first and second branch lines VI and V. Air led to the first branch line VI is led to the right chamber of the cylinder 48 to cause movement of the driving piston 42 to the left. This operation corresponds to the advance of the push bar 21 interlocked with the lever 14.

Air led to the second branch line V flows into the lower chamber of the cylinder 50 to raise the feed piston 44. The movement of the feed piston 44 is transmitted to the ratchet mechanism via a link mechanism 43. If this direction of rotation is set as the idling direction of the ratchet mechanism, the shaft, and hence the rotor, are not roated at this time.

When the push button 45 is released after completion of the rivet driving operation, the operating valve 46 is returned to the initial position by the spring 51, thus switching over the operating valve 46. Air is thus led through a line II into the left chamber of the cylinder 48, thus causing movement of the driving piston 42 to the right. As a result, the push bar is retracted to its initial position. When the driving piston 42 reaches the right end of the stroke, the left chamber of the cylinder 48 is communicated with the line III via the duct 49a. As a result, air is caused to flow through the line III into the upper chamber of the cylinder 50, thus lowering the feed piston 44. The descent of the feed piston 44 is transmitted to the ratchet mechanism through the link mechanism 43. The pawl is thus brought into engagement with the rachet teeth to cause rotation of the shaft, so that the rivet belt is fed by the rotor.

Thus, once the rivet belt is inserted into the guide space, the main portion 2*a* for the leading rivet is engaged with the rotor, and the push button 45 is depressed several times until the leading rivet is loaded in the push bar, whereafter a rivet can be driven every time the push button 45 is operated. In this way, the rivets can be driven up to the last rivet. After the last rivet has been driven, the push button 45 is operated several times until the main portion 2*a* of the metal strip 2 is released from the rotor. Now, the main portion 2*a* can be taken out of the guide space together with the stubs of the branch portions.

In the above embodiments, the guide space has a substantially U-shaped form. However, this is by no means limitative, and it is possible to provide a straight guide groove. Further, an auxiliary holder, which accommodates a rivet belt in the form of a roll, may be provided at the inlet of the guide space. In this case, a very long rivet belt can be used.

As has been described in the foregoing, according to the invention a rivet belt can be loaded as such and the rivets can be driven one by one by inserting each through aligned holes of panels for the joining thereof. In addition, there is no danger of stubs of the branch portions of the metal strip (i.e. the segments of the branch portions above the respective low mechanical strength portions) being scattered about by the driving of the rivets, as these stubs remain integral with the main portion of the metal strip. This is very convenient since there is no need to gather up the stubs after completion of the riveting operation.

Further, since the rivet is driven after the associated branch portion of the metal strip has been bent to assume an orientation different from that of the other branch portions, the rivet belt that is used with the rivet driver according to the invention may consist of a metal strip having a main portion and integral branch portions, and rivets formed on the branch portions by injection molding. This is desirable from the standpoint of reducing or eliminating the waste of the material of the metal strip. Besides, a number of rivets can be driven in succession even if the guide space of the rivet driver has a small length.

What is claimed is:

1. A rivet driver used with a rivet belt, said rivet belt comprising a metal strip having an elongate main portion and integral branch portions extending from and at right angles to said main portion and arranged at a predetermined pitch, each of said branch portions having a longitudinally intermediate low mechanical strength portion, and plastic rivets formed one each by injection molding on said branch portions of said metal strip and having a flange formed at the end thereof nearer said main portion, said rivets each being adapted to be inserted through a hole in a work and then squeezed out from the branch portion so as to spread under the work to thereby clamp the work between the lower surface of the flange and the spread portion, the branch portion thereafter being separated from said rivet at said low mechanical strength portion, said rivet driver comprising:

a guide space through which said rivet belt is fed;

rivet feeder means for feeding said rivet belt through said guide space stepwise at increments equal to the pitch of said branch portions;

re-directing means operable in an interlocked relation with the feeding operation of said rivet feeder means for bending the branch portion associated with the rivet located at a driving position in said guide space so that the rivet assumes a different orientation from that of the other rivets in said rivet belt;

squeezing means for pushing the flange of the re-directed rivet to thereby squeeze out the rivet from the branch portion; and a restoring mechanism for bending back and restoring the initial orientation of the branch portion bent by said re-directing means and leading the restored branch portion back to said guide space.

* * * * *